United States Patent [19]

Hughes

[11] 4,425,755

[45] Jan. 17, 1984

[54] GAS TURBINE DUAL FUEL BURNERS

[75] Inventor: Eric Hughes, Nuneaton, England

[73] Assignee: Rolls-Royce Limited, London, England

[21] Appl. No.: 300,747

[22] Filed: Sep. 10, 1981

[30] Foreign Application Priority Data

Sep. 16, 1980 [GB] United Kingdom ..... 8029928

[51] Int. Cl.[3] ..... F02C 7/00

[52] U.S. Cl. ..... 60/39.55; 60/742; 60/748

[58] Field of Search ..... 60/742, 39.55, 748, 60/746, 747

[56] References Cited

U.S. PATENT DOCUMENTS

| | | | |
|---|---|---|---|
| 3,980,233 | 9/1976 | Simmons et al. | 60/748 |
| 4,023,351 | 6/1977 | Beyler et al. | 60/742 |
| 4,327,547 | 5/1982 | Hughes et al. | 60/742 |
| 4,337,618 | 7/1982 | Hughes et al. | 60/39.55 |

*Primary Examiner*—Louis J. Casaregola

*Assistant Examiner*—Timothy S. Thorpe

*Attorney, Agent, or Firm*—Darby & Cushman Cushman

[57] ABSTRACT

A dual fuel burner for a gas turbine engine comprises a gas fuel manifold and ducts opening into a central air passage, a liquid fuel manifold and tangentially arranged apertures opening into an annular liquid fuel passage terminating in an annular nozzle. The central air passage has an upstream swirler, and is arranged to receive a flow of compressed air at its upstream end and to discharge a flow of compressed air and either gaseous or liquid fuel from its downstream end. The burner also has a water manifold so that water can be injected into the fuel and air flow via ducts and an annular air passage, to control NOx emission.

In an alternative arrangement, the liquid fuel can be injected into the annular air passage.

The burner is intended to operate on a range of high calorific fuels, both liquid and gaseous, and is designed to minimize the surface area on which carbon may accumulate during operation.

3 Claims, 6 Drawing Figures

GAS TURBINE DUAL FUEL BURNERS

Figure 1:
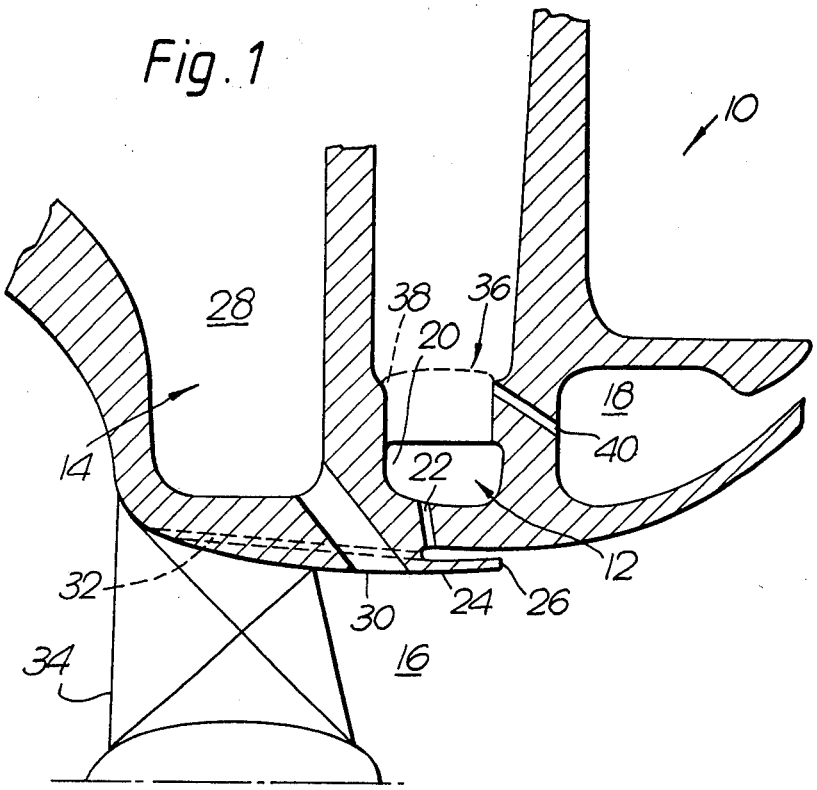

This invention relates to fuel burners or injectors for gas turbine engines, which are capable of burning a number of liquid and gaseous fuels (particularly diesel fuel in the case of liquid fuels) and which can also inject water to control pollutants, such as $NO_x$.

The design of a dual fuel injector requires in the case of the gaseous fuel that a range of fuels having different calorfic values and densities can be burnt without having to provide outlet nozzles of different sizes for the different fuels, and that the gas flow passages can be purged when the injector is operating on liquid fuel to prevent the liquid fuel and/or combustion products from entering the gas flow passages.

In the case of liquid fuels it is necessary that atomisation of the fuel is complete as far as is possible before combustion takes place and that the deposition of any carbon produced by combustion on the injector is also kept to a minimum. The deposition of carbon can be a serious problem as it builds up on the injector and other parts of the combustion system and breaks off in lumps to damage downstream parts of the engine, e.g. the high pressure turbine blades. This problem is made worse when the less expensive but heavier fuels such as diesel oil are being burnt.

U.S. Pat. No. 4,327,547, issued May 4, 1982, to Hughes et al., and assigned to Rolls-Royce Limited, shows a dual fuel burner in which the relatively low pressure liquid fuel is injected into an annular passage containing a flow of high velocity and high pressure air. This arrangement known as air blast atomisation provides a very effective method of atomising the liquid fuel, but in some circumstances, a hollow central member or pintle which defines one side of the annular passage tends to become deposited with carbon even though means are provided to air wash the surfaces of the pintle.

The gaseous fuel passages of this burner are arranged so that the burner can accept a range of gas fuels without modification and a purging system is provided to prevent a build-up of combustible products in the gas passages. However, since the gas fuel does not flow into the same annular passage as the liquid fuel, but rather into a separate annular manifold around the outside of the liquid fuel passage the burner tends to be of larger diameter than desirable. This larger diameter can cause difficulties if the burner is to be retro-fitted to an existing combustion system.

Similar problems exist with the dual fuel burner shown in our U.S. Pat. No. 4,337,618, issued June 6, 1982, to Hughes et al., and assigned to Rolls-Royce Limited, though in this case the central pintle is solid giving a larger surface area on which carbon can be deposited and the gas fuel outlet nozzles have to be of different sizes to allow for fuels of different calorific values and densities.

The present invention seeks to provide a dual fuel burner for a gas turbine engine which retains the advantageous features of the previous proposals and removes at least some of the disadvantageous features. In particular, the present invention seeks to provide a duel fuel burner in which the method of liquid fuel atomisation as outlined above is retained, this method also being shown in U.S. Pat. No. 3,980,233, issued Sept. 14, 1976, to Simmons et al., and assigned to Parker-Hannifin Corporation, the burner diameter is kept to a minimum by injecting the gas fuel into the same central duct which receives the liquid fuel, and removing the central pintle thereby reducing the surface area on which carbon can be deposited.

Accordingly the present invention provides a dual fuel burner for a gas turbine engine, the burner comprising liquid fuel ducting, gaseous fuel ducting a central air passage open at both ends to receive a flow of compressed air at its upstream end and to discharge a flow of compressed air and fuel at its downstream end, and an annular air passage arranged to discharge air adjacent the downstream end of the central air passage, the liquid fuel ducting including an annular passage having an annular nozzle in communication with one of the air passages, fuel swirling means to swirl the fuel in the annular fuel passage, the gaseous fuel ducting having fuel swirling means and outlets into one of the air passages, the central air passage having air swirling means upstream of the entry of fuel into the central passage. The air swirling means in the central air passage may include a hollow hub through which air is able to flow to prevent the deposition of carbon.

In one embodiment, the liquid fuel nozzle and the gaseous fuel outlets are arranged to inject the respective fuel into the central air passage, whilst in another embodiment the liquid fuel outlets are arranged to inject the liquid fuel into the annular air passage.

The central air passage may be generally divergent downstream of the annular fuel nozzle and in one embodiment the central air passage may include a nozzle of the Coanda type provided to induce the fuel to adhere to the surface of the central air passage.

The liquid and gaseous fuel swirling means may comprise a plurality of tangentially arranged apertures injecting the respective fuels into the respective fuel passages.

The burner can also include water ducting having outlets into the annular air passage which may include air swirling means so that water can be properly placed in the combustion system to reduce the production of NOx by reducing the combustion temperature.

The burner will if necessary, also have purging ducting, typically comprising a number of ducts in communication with the gas fuel outlets, the ducts receiving a flow of compressed air.

Figure 2:
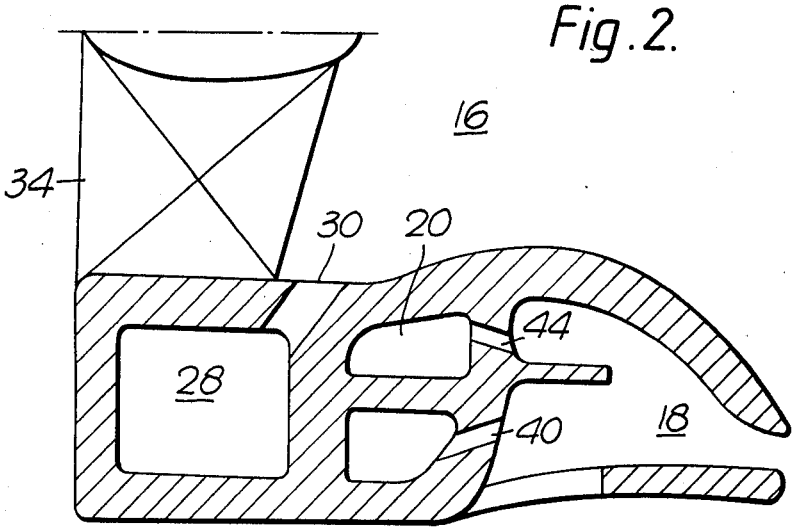
Figure 3:
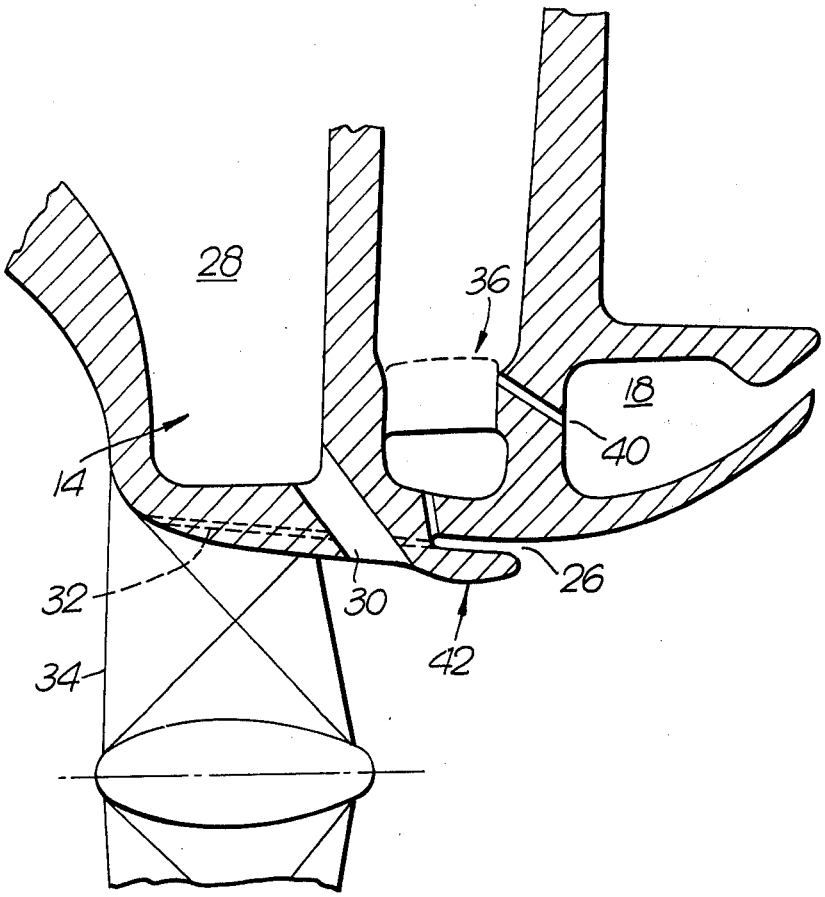

The present invention will now be more particularly described with reference to the accompanying drawings in which, FIG. 1 shows in half section one form of dual fuel burner according to the present invention, FIG. 2 shows in half-section a further form of dual fuel burner according to the present invention, FIG. 3 shows in half-section a modified form of the dual fuel burner shown in FIG. 1.

Figure 4:
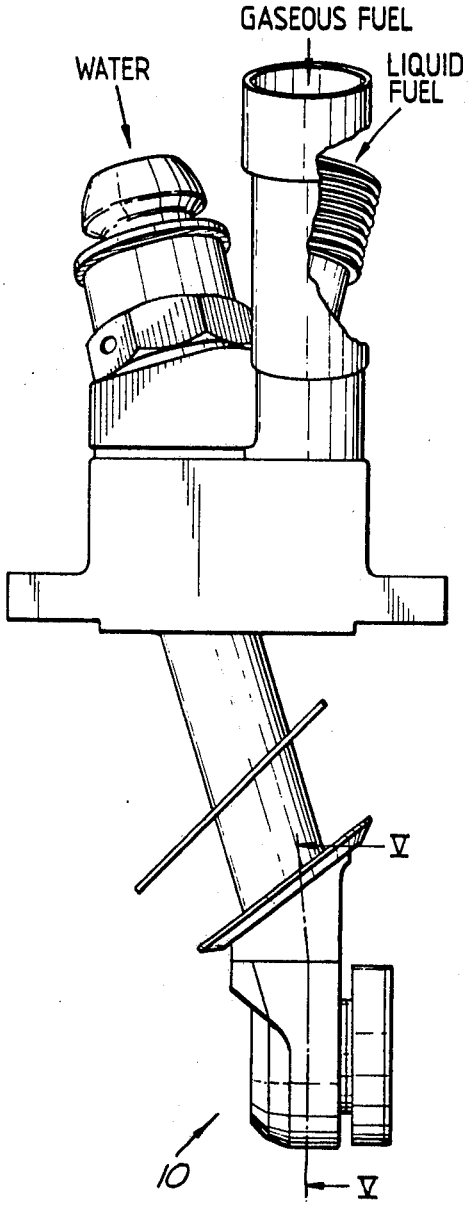
Figure 5:
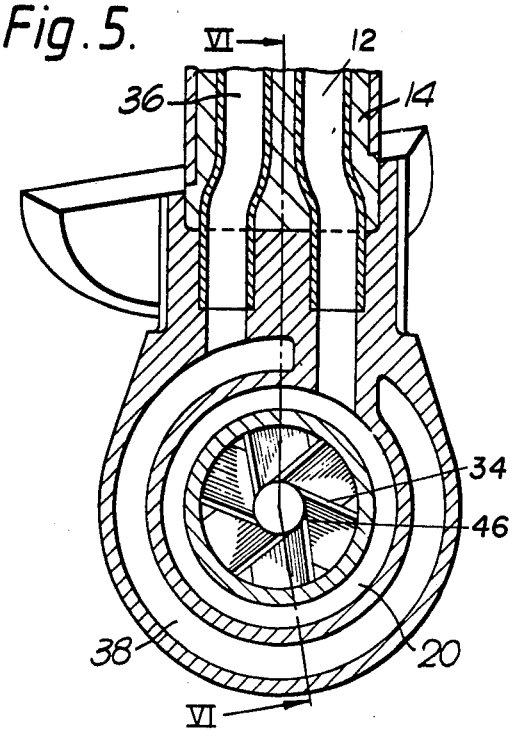
Figure 6:
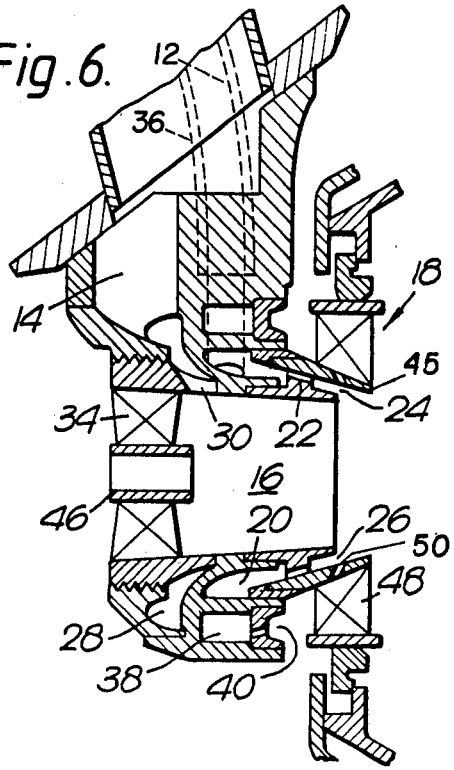

FIG. 4 shows an elevation of a further form of dual fuel burner according to the present invention, FIG. 5 is a section on line 5—5 in FIG. 4, and FIG. 6 is a section on line 6—6 in FIG. 5

Referring to FIG. 1, a dual fuel burner 10 for a gas turbine engine (not shown) comprises liquid fuel /ducting 12, gaseous fuel ducting 14, a central air passage 16 and an annular air passage 18. The liquid fuel ducting 12 comprises a liquid fuel manifold 20, a number of apertures 22 in communication between the manifold and an annular fuel passage 24, the apertures being tangentially arranged with respect to the annular passage 24 so that fuel entering the passage 24 is given a swirl component of motion. The passage 24 terminates in an annular nozzle 26 in through which swirling fuel can be injected into the central air passage 16 in the form of a sheet.

The gaseous fuel ducting includes a manifold 28 and a number of inclined outlet apertures 30 through which gas fuel is injected with a swirling motion into the central passage 16. Purge apertures 32 are also provided in the fuel burner in communication with the annular nozzle 26 so that air flowing through the purge apertures prevents gas fuel and/or combustion products from entering the liquid fuel ducting.

The central air passage 16 which is open at both ends has an air swirler 34 at its upstream inlet end which can be arranged to swirl the incoming air either in the same direction or in the opposite direction to the direction of swirl of the liquid fuel issuing from the nozzle 26. The central air passage 16 is generally divergent downstream of the nozzle 26 and the outlets of both the central air passage and the annular air passage are adjacent one another.

The burner 10 also has water ducting 36 comprising a water manifold 38 and ducts 40 connecting the manifold 38 with the air passage 18. This arrangement allows water to be properly placed in the combustion system by the air flowing from the air passage 18 to reduce combustion temperature, thereby reducing the production of $NO_x$.

When liquid fuel is being burnt, the fuel leaves the nozzle 26 in the form of a relatively thin swirling sheet and interacts with the swirling high velocity flow of compressed air in the central passage 16, the compressed air coming from the compressor of the gas turbine engine. The interaction of the air and fuel tends to render the sheet of fuel unstable, the sheet tending to breakdown into random streams and then into droplets. At the outlet of the central air passage 16, the fuel which by this time is at least partially in droplet form; although some sheet and stream elements may still be present, is subjected to the flow of air from the annular passage 18. This flow of air imports further instability to the fuel causing the fuel atomisation to be substantially completed.

The downstream end of the central air passage 16 is generally divergent and the action of the air swirler 34 is to centrifuge most of the air towards the wall of the passage which tends to retain the fuel sheet on the divergent part of the passage. As shown in FIG. 3 this effect can be enhanced by providing a throat 42 just upstream of the fuel nozzle 26 to suppress wakes from the swirler.

Throughout the period of running on gaseous fuel compressed air is flowing through the purge apertures 32 to prevent gaseous fuel and/or combustion products from the combustion system from entering the ducting 12. When the burner is operating on liquid fuel, the gas fuel ducting 14 is self-purging and is filled with compressed air entering through the apertures 30.

When running on gaseous fuel, the swirling fuel enters the central passage 16 through the outlets 30 and mixes with the swirling air in the passage 16 and ultimately is impinged upon by the air flowing from the annular passage 18. This method of injecting the gaseous fuel allows fuels of different calorific values and thus densities to be injected without the need for outlet apertures of different sizes for the different gases as compared with the gas burner in the aforementioned U.S. Pat. No. 4,337,618. In that arrangement, the gas fuel passed directly from the outlet apertures into the combustion system. This meant that the size of the apertures determined the momentum of the gas entering the combustion system and therefore its placement and the aperture sizes may have to differ for different gases. In the present arrangement the gas fuel is first mixed with the air before injection into the combustion system so that the final momentum of the gas and air mixture is substantially independent on the size of the apertures 30.

Since the gas fuel is injected into the same air passage as the liquid fuel, there is no need to provide a separate passage from which the gas fuel or the gas fuel and air mixture can be injected into the combustion system. Such a separate passage would probably need to be an annular passage around the outside of the existing air passage such as shown in our previously referred to patent applications, and would result in a burner of an inconveniently large outer diameter. A burner with such a larger diameter would be difficult to fit in the place of a single fuel burner, as is sometimes desirable when converting a gas turbine engine to run on liquid and gaseous fuels. A burner according to the present invention could be retro-fitted with a minimum of alteration to an existing combustion system.

FIG. 2 shows a form of burner according to the present invention in which the liquid fuel is injected from the manifold 20 through ducts 44 into the annular passage 18, the fuel forming into a sheet on the outer wall of the passage 16 and interacting with compressed air flowing through the passage 18. The mechanism of atomisation is analogous to that described with reference to FIG. 1 with the air in passage 18 taking the role of the air in passage 16 and vice versa. This form of burner also avoids the need for a separate gas fuel outlet passage and should not make the outer diameter of the burner any greater than that of the burner shown in FIGS. 1 and 3.

Referring to FIGS. 4, 5, 6 in which components and features have been given the same reference numerals as the corresponding components and features in the previous embodiments, the fuel burner 10 is similar to the burner shown in the aforementioned U.S. Pat. No. 3,980,233 which is designed to operate only on liquid fuel, whereas in the present case, the burner is able to operate on a range of gaseous fuels, and includes a water injection system. There are a number of important structural and functional differences between this and the previous embodiments. The liquid fuel from the manifold 20 is injected through apertures 22 which give the fuel a swirling motion, into the swirling air issuing from the central passage 16, and the fuel is constrained by a lip or sleeve 45. The swirler 34 has a hollow hub 46 to allow the throughflow of compressed air to prevent carbon accretion on the hub. In the absence of a hollow hub, deposits of carbon can build up because the swirling gas flow in the passage 16 tends to migrate to the wall of the passage, creating a depression in the centre of the passage into which combustion products can flow. An air swirler 48 forms the annular air passage 18 and water is injected from the manifold 38 via the apertures 40 directly into the air entering the swirler 48. Thus, a mixture of swirling air and water can be accurately placed in the combustion chamber, a part of which is illustrated in FIG. 6, to control the combustion temperature, thereby controlling the level of NOx emission.

The gaseous fuel duct 14 does not have separate purge ducts as in the previous embodiments because the swirling flow of fuel is sufficient to prevent the ingress of fuel and/or combustion products into the gas duct.

The liquid fuel ducting may be purged by the provision of apertures 50 in the lip or sleeve 45 which allow air to flow through the apertures preventing gas fuel and/or combustion products from flowing into the manifold 20.

The burner according to the invention has (a) eliminated a central pintle, apart from the hub for the upstream swirler thereby reducing the surface area on which carbon can be deposited, a significant advantage particularly when burning diesel fuel, (b) retained the method of air blast atomisation, (c) the burner is able to burn the high calorific gas fuels, such as methane, propane and ethane which have different densities, without a change in the gas inlet nozzles because of the manner in which the gas fuel is placed into the swirling air flow in the central passage. The different densities of gas fuels enter the central passage each with a different momentum, but the energy interchange between the fuels and the swirling air is such that the final momentum of each gas fuel and air mixture as it leaves the central passage are close enough to each other that the fuel is correctly placed in the combustion chamber. If the gas fuel were to be injected directly into the combustion chamber through a ring of nozzles, e.g. as in the aforementioned U.S. Pat. No. 4,327,547, then different fuels would require different nozzles. Otherwise the fuel would be placed either too close to the head of the combustion chamber or too far down the combustion chamber, e.g. too close to the walls (d) the controlled injection of gas fuel into the swirling air improves mixing and eliminates the potential bias encountered in annular injectors, e.g. local rich and weak zones (e) Coanda problems associated with annular injectors are eliminated by the air and gas swirl energy, (f) the cone angle of the gas and air can be controlled by the design of the air swirler (g) the pressure drop of the gas can be lower as the pressure drop of the air flow through the burner can be used and (h) as regards diesel fuel the feature of subjecting the fuel to a double air shear is retained which has proved effective for good atomisation and mixing.

What we claim is:

1. A gas turbine engine dual fuel burner comprising liquid fuel ducting, gaseous fuel ducting, a central air passage, an annular air passage, and water ducting, said liquid fuel ducting including an annular liquid fuel passage opening into said central air passage and formed between said central air passage and an outer sleeve which terminates downstream of the end of said central air passage, said annular liquid fuel passage containing angled apertures through which liquid fuel is constrained to flow and which impart a swirling motion to the liquid fuel, said central air passage being axial and open at both ends to receive a flow of compressed air at its upstream end for flow in a direction parallel to the longitudinal axis of said central air passage and to discharge a flow of compressed air and fuel from its downstream end, said central air passage having axial air swirling means adjacent its upstream end and upstream of injection of fuel into the same, said gaseous fuel ducting having angled outlets opening into said central air passage immediately downstream of said air swirling means and arranged to impart a swirling motion to the gaseous fuel, said annular air passage containing an axial air swirling means and being located adjacent the downstream end of said outer sleeve, said water ducting including a manifold having outlets to inject water into air flowing into said annular air passage.

2. A fuel burner as claimed in claim 1 in which said axial air swirling means in said central air passage has a hollow hub through which air can flow in a direction parallel to the longitudinal axis of the central air passage.

3. A fuel burner as claimed in claim 1 in which said sleeve is provided with a number of apertures to allow air from said annular air passage to flow across said annular liquid fuel passage to prevent the ingress of combustible matter into the liquid fuel ducting.

* * * * *